US009443682B2

(12) United States Patent
Yang

(10) Patent No.: US 9,443,682 B2
(45) Date of Patent: Sep. 13, 2016

(54) TEMPERATURE SWITCH

(71) Applicant: Yu-Kang Yang, Tainan (TW)

(72) Inventor: Yu-Kang Yang, Tainan (TW)

(73) Assignee: Yu-Kang Yang, Tainan (TW)

( * ) Notice: Subject to any disclaimer, the term of this patent is extended or adjusted under 35 U.S.C. 154(b) by 317 days.

(21) Appl. No.: 14/159,613

(22) Filed: Jan. 21, 2014

(65) Prior Publication Data

US 2015/0206680 A1 Jul. 23, 2015

(51) Int. Cl.

| | |
|---|---|
| ***H01H 37/46*** | (2006.01) |
| ***H01H 37/00*** | (2006.01) |
| ***H01H 37/48*** | (2006.01) |
| ***H01H 37/52*** | (2006.01) |
| *H01H 85/58* | (2006.01) |
| *H01H 37/72* | (2006.01) |
| *H01H 85/00* | (2006.01) |
| *H01H 73/34* | (2006.01) |
| *H01H 1/26* | (2006.01) |

(52) U.S. Cl.

CPC ..... *H01H 37/002* (2013.01); *H01H 37/46* (2013.01); *H01H 37/48* (2013.01); *H01H 37/52* (2013.01); *H01H 1/26* (2013.01); *H01H 37/72* (2013.01); *H01H 73/34* (2013.01); *H01H 85/58* (2013.01); *H01H 2085/0004* (2013.01); *H01H 2085/0008* (2013.01)

(58) Field of Classification Search

CPC ..... H01H 37/64; H01H 37/72; H01H 73/34; H01H 85/36; H01H 85/58; H01H 2085/0004; H01H 2085/0008; H01H 37/002; H01H 37/46; H01H 37/48; H01H 37/52; H01H 1/26

USPC ..... 337/3, 13, 143, 144, 147, 298, 299, 412

See application file for complete search history.

(56) References Cited

U.S. PATENT DOCUMENTS

| | | | | |
|---|---|---|---|---|
| 5,650,913 | A * | 7/1997 | Kochanski | H01L 23/4093 257/727 |
| 6,239,686 | B1 * | 5/2001 | Eder | H01H 37/323 337/123 |
| 6,583,711 | B2 * | 6/2003 | Yang | H01H 37/48 337/123 |
| 6,741,159 | B1 * | 5/2004 | Kuczynski | H01H 37/002 337/142 |
| 7,209,336 | B2 * | 4/2007 | Yu | H01C 7/126 200/400 |
| 7,639,114 | B2 * | 12/2009 | Yu | H01H 37/761 29/623 |
| 7,750,788 | B2 * | 7/2010 | Yu | H01H 37/002 337/13 |
| 8,665,057 | B2 * | 3/2014 | Schlenker | H01H 37/761 337/239 |
| 2006/0250209 | A1 * | 11/2006 | Yu | H01H 37/002 337/36 |
| 2007/0188293 | A1 * | 8/2007 | Yang | H01H 37/5427 337/400 |

* cited by examiner

*Primary Examiner* — Anatoly Vortman
*Assistant Examiner* — Jacob Crum
(74) *Attorney, Agent, or Firm* — Amin, Turocy & Watson LLP

(57) ABSTRACT

A temperature switch electrically interconnects a first wire and a second wire, and includes a conducting mechanism and a temperature control mechanism controlling electrical connection between the first and second wires using the conducting mechanism in a normal condition. The conducting mechanism includes a safety unit composed of a conducting resilient bracket and a deformable component abutting against the conducting resilient bracket, thereby enabling the conducting resilient bracket to electrically interconnect the first and second wires. The deformable component is deformed upon reaching a specific temperature, such that interconnection between the first and second wires made via the conducting resilient bracket is broken.

7 Claims, 7 Drawing Sheets

TEMPERATURE SWITCH

BACKGROUND OF THE INVENTION

1. Field of the Invention

The invention relates to a switch, and more particularly to a temperature switch that may cut off power supply of an electric device when an abnormal temperature condition exists.

2. Description of the Related Art

A common electrical appliance configured for heating, such as a water dispenser, a coffeemaker, an electrical iron, a hairdryer, etc., employs a heater for heating.

Such an electrical appliance usually includes a temperature switch and a fuse to keep a desired temperature and to prevent danger resulting from abnormal operation of the heater. Although safety may be ensured, installation of the two components (i.e., the temperature switch and the fuse) in a limited space of the electrical appliance may disfavor assembly process. Referring to FIGS. 1 and 2, commonly owned co-pending U.S. patent application Ser. No. 13/406,946 discloses a temperature switch 1 that abuts against a heating component 10, that electrically interconnects two wires 11, and that includes a base 12, a conducting mechanism 13 and a temperature control mechanism 14.

The base 12 includes a base body 121, and a cap body 123 that is connected to the base body 121 to form an accommodating chamber 122 therebetween and that has a limiting hole 124. The conducting mechanism 13 includes two conducting pieces 131, 132 respectively and electrically connected to the wires 11, a fixed conducting rod 133 installed on the base body 121 and electrically connected to the conducting piece 131, a conducting resilient piece 135 installed within the accommodating chamber 122 via a coupling component 134, and two fuses 136 electrically interconnecting the conducting piece 132 and the conducting resilient piece 135. The temperature control mechanism 14 includes a temperature sensing cap 142 that cooperates with the cap body 123 to form a deformation space 141, a temperature-sensing control plate 143 disposed in the deformation space 141, and a linking rod 144 disposed movably in the limiting hole 124. The linking rod 144 is biased between the temperature-sensing control plate 143 and the conducting resilient piece 135.

In a normal operation state, the linking rod 144 is biased by the temperature-sensing control plate 143, such that the conducting resilient piece 135 is biased to abut against the fixed conducting rod 133, thereby permitting current flow through the conducting piece 131, the fixed conducting rod 133, the conducting resilient piece 135, the fuses 136, and the conducting piece 132. When the heating component 10 reaches a specified temperature, the temperature-sensing control plate 143 deforms as shown in FIG. 2, and the conducting resilient piece 135 restores and is separated from the fixed conducting rod 133. When the temperature is abnormally high, and the temperature-sensing control plate 143 is disabled from deformation or the conducting resilient piece 135 loses its restoring ability, the fuses 136 are melted, so as to cut off current flow between the conducting piece 132 and the conducting resilient piece 135.

Ideally, the aforesaid temperature switch 1 may ensure safety. However, in practice, since each of the fuses 136 stands as a pillar, the fuses 136 are apt to melt incompletely, thereby failing to break electrical connection.

SUMMARY OF THE INVENTION

Therefore, an object of the present invention is to provide a temperature switch that may have a relatively high reliability to cut off current flow.

According to the present invention, a temperature switch is adapted to be electrically connected with a first wire and a second wire. The temperature switch comprises:

a base body;

a cap body connected to the base body to form an accommodating chamber therebetween;

a conducting mechanism including a first conducting piece adapted to be electrically connected to the first wire, a second conducting piece adapted to be electrically connected to the second wire, a fixed conducting component, a conducting resilient piece that is disposed in the accommodating chamber, that is electrically connected to the first conducting piece, and that is contactable with the fixed conducting component, and a safety unit, the safety unit including a conducting resilient bracket, and a temperature-dependent deformable component abutting against the conducting resilient bracket to bias the conducting resilient bracket into a conducting state where the conducting resilient bracket electrically interconnects the fixed conducting component and the second conducting piece, wherein the temperature-dependent deformable component is configured to be deformed upon reaching a specific temperature, such that the conducting resilient bracket is changed to a non-conducting state where the conducting resilient bracket is separated from one of the second conducting piece and the fixed conducting component; and a temperature control mechanism configured to control contact between the conducting resilient piece and the fixed conducting component with a sensed temperature.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
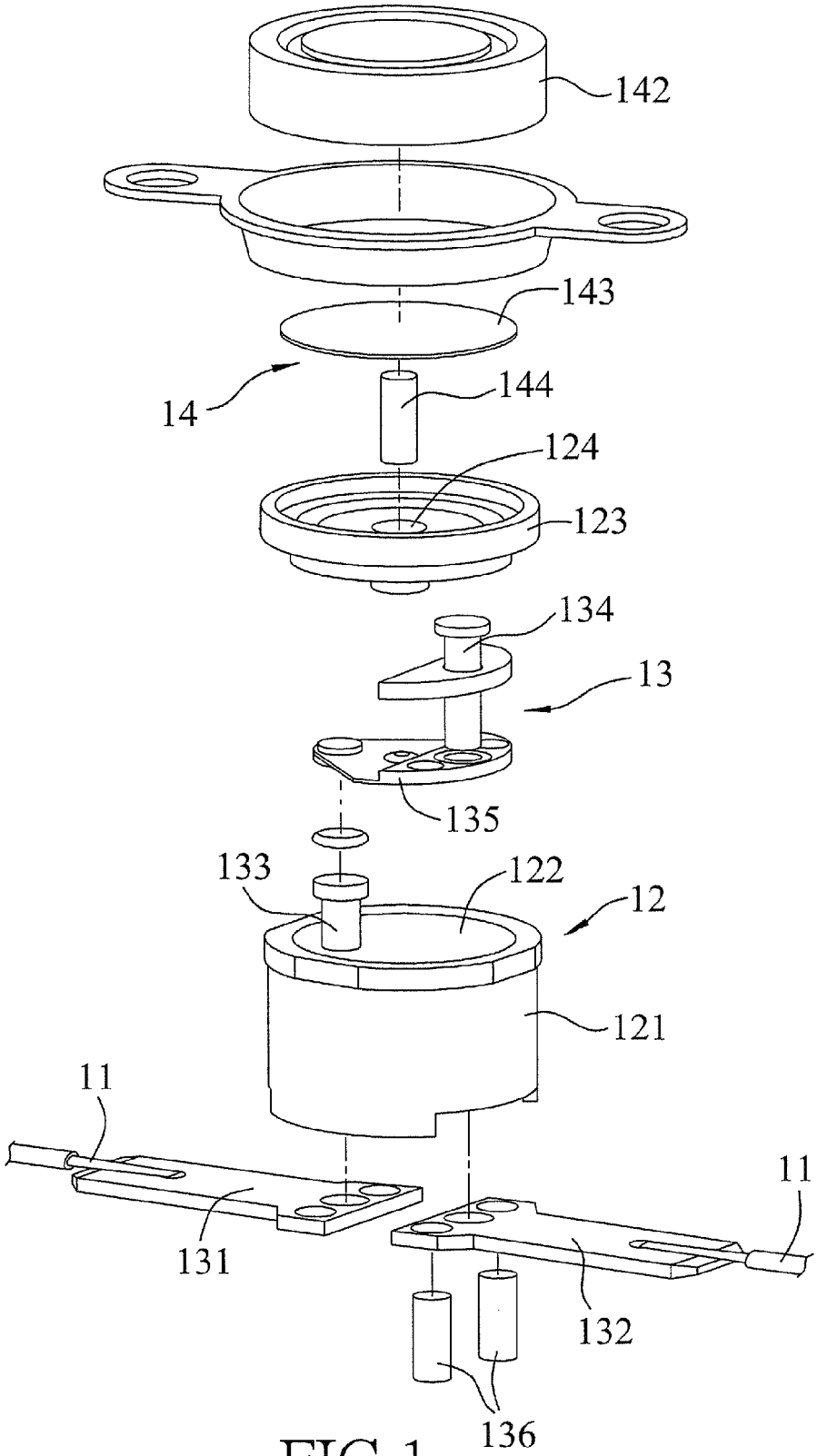
FIG.1 PRIOR ART
FIG. 1 is an exploded perspective view illustrating a temperature switch disclosed in U.S. patent application Ser. No. 13/406,946.
Figure 2:
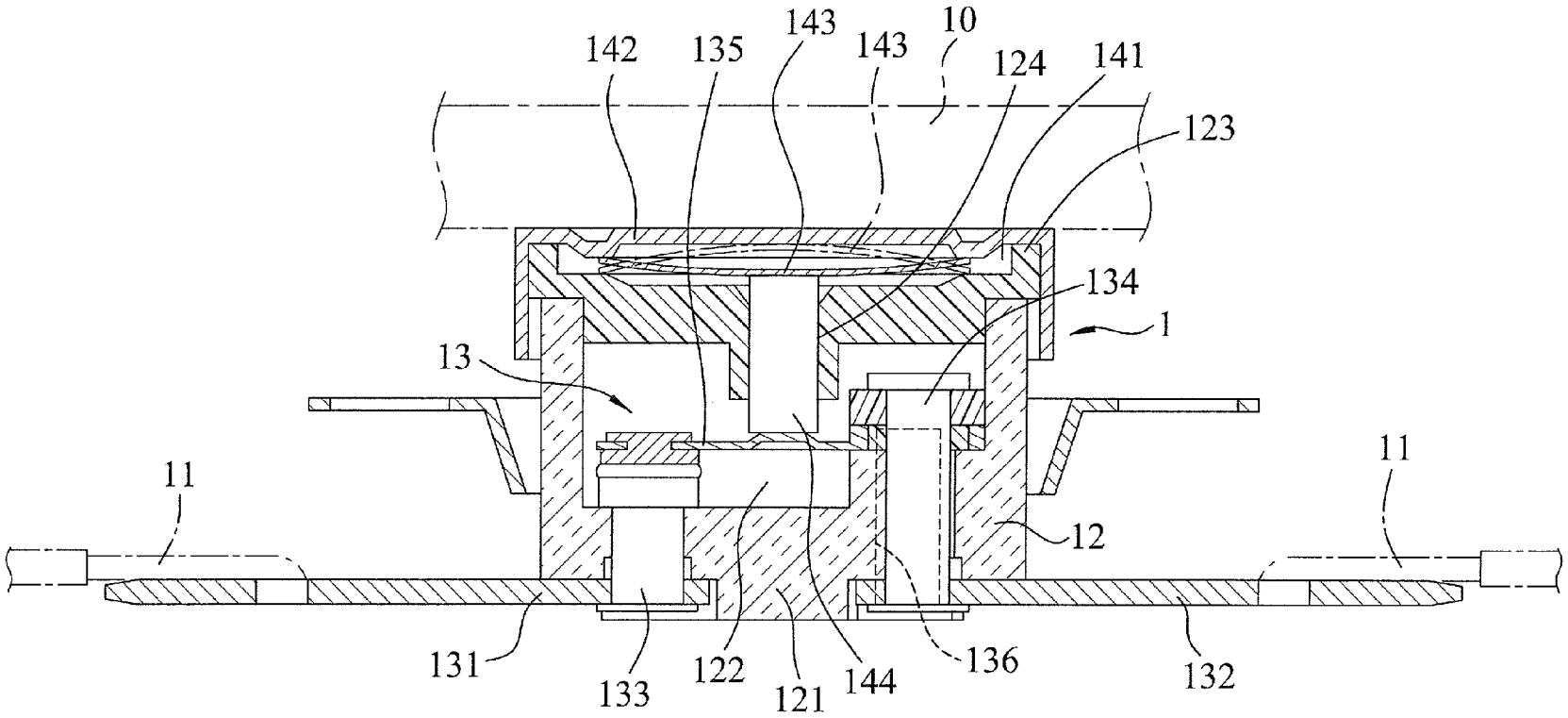
FIG.2 PRIOR ART
FIG. 2 is a sectional view of the temperature switch shown in FIG. 1.
Figure 3:
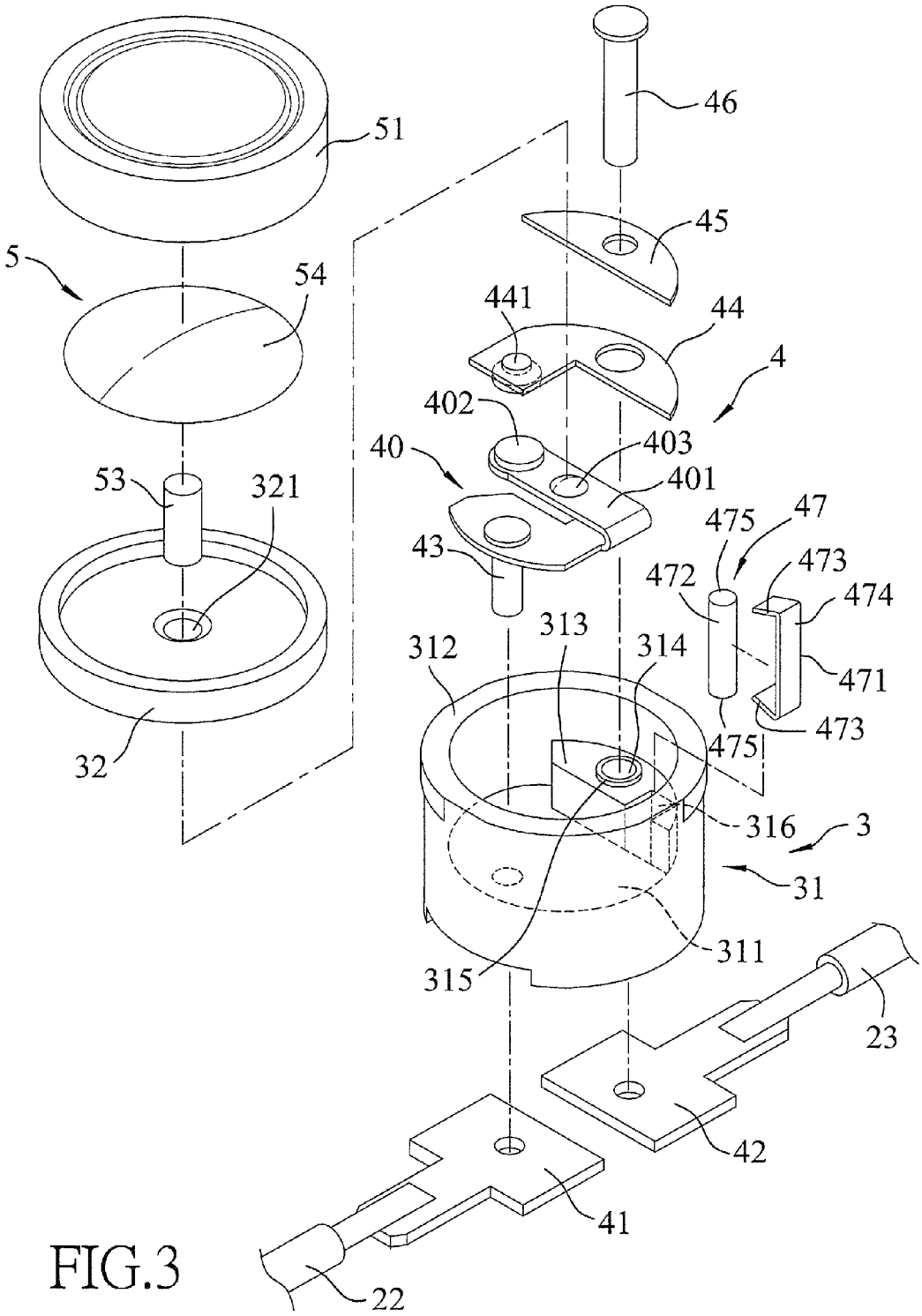
FIG. 3 is an exploded perspective view illustrating a preferred embodiment of a temperature switch according to the present invention.
Figure 4:
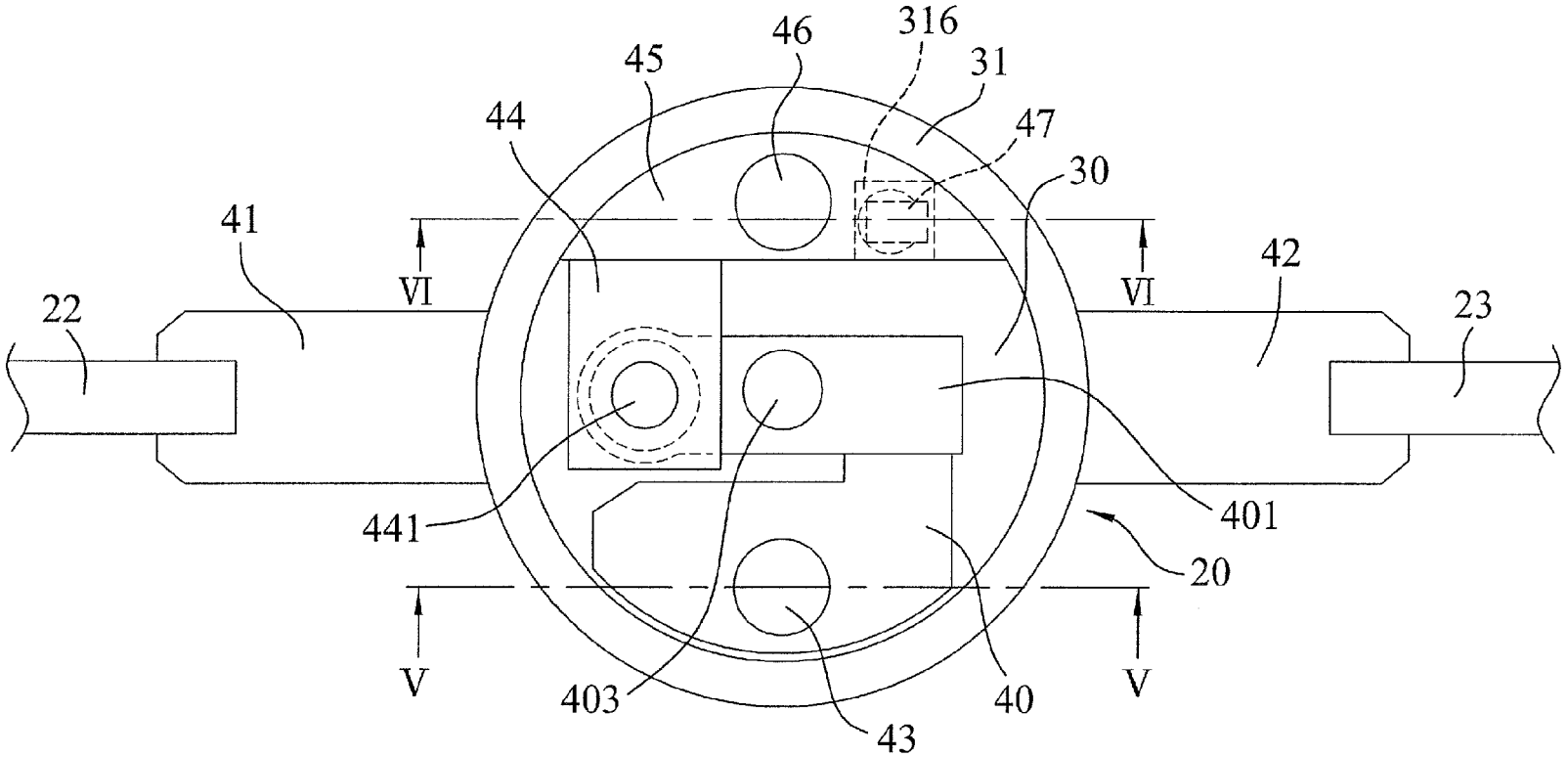
FIG. 4 is a fragmentary top view of the preferred embodiment, a temperature control mechanism and a cap body of the preferred embodiment being omitted for the sake of clarity.
Figure 5:
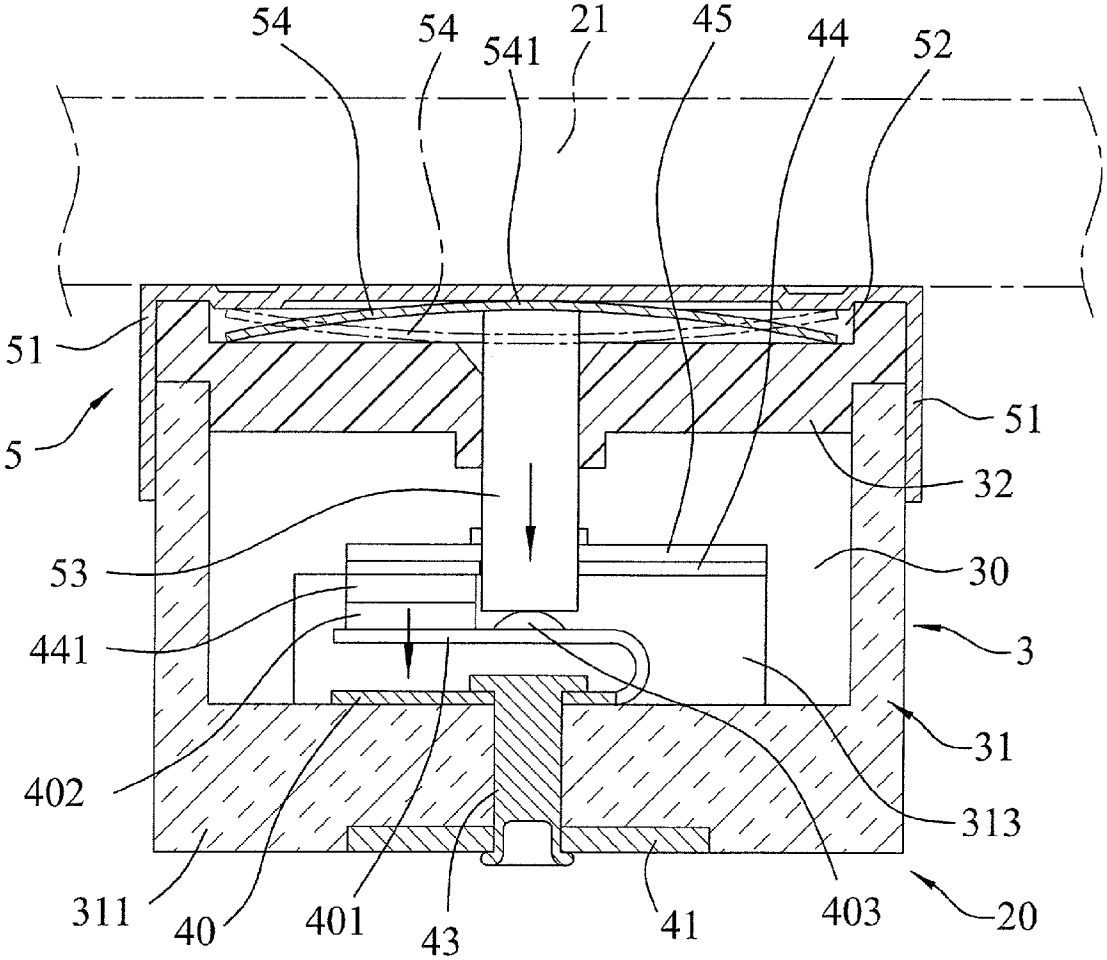
FIG. 5 is a sectional view taken along line V-V in FIG. 4.

Referring to FIG. 3 to FIG. 5, the preferred embodiment of the temperature switch 20 according to the present invention is to be installed on an electrical appliance (not shown), and is in contact with a heating component 21. The temperature switch 20 is adapted to electrically interconnect a first wire 22 and a second wire 23, and comprises a base 3, a conducting mechanism 4 installed on the base 3, and a temperature control mechanism 5 installed on the base 3.

In this embodiment, the base 3 includes a base body 31 made of an insulating and high temperature resistant material, such as a ceramic material or a plastic material, and a cap body 32 connected to the base body 31 to form an accommodating chamber 30 therebetween. The base body 31 has a base wall 311, a surrounding wall 312 extending upwardly from a periphery of the base wall 311 toward the cap body 32, a platform 313 extending upwardly from the base wall 311, a mounting hole 314 that passes through the base wall 311 and the platform 313, an isolating ring 315 that protrudes from the platform 313 and that surrounds the mounting hole 314, and a receiving space 316 that passes through the platform 313 and the base wall 311. The cap body 32 has a limiting hole 321 formed in a central portion of the cap body 32.

The conducting mechanism 4 includes: a first conducting piece 41 adapted to be electrically connected to the first wire 22; a second conducting piece 42 adapted to be electrically connected to the second wire 23; a conducting rod 43 that electrically interconnects the first conducting piece 41 and a conducting resilient piece 40 in the accommodating chamber 30 and that mounts the first conducting piece 41 and the conducting resilient piece 40 to the base wall 31; a fixed conducting component 44; an insulating spacer 45 that is made of an insulative material and that is disposed above and abuts against the fixed conducting component 44; a mounting component 46 that has a head and that extends through the mounting hole 314 to mount the insulating spacer 45, the fixed conducting component 44, and the second conducting piece 42 to the base body 31; and a safety unit 47 received in the receiving space 316 of the base 3. In this embodiment, the fixed conducting component 44 is sleeved on the isolating ring 315 for preventing the inner surface of the fixed conducting piece 44 from coming into contact with the outer surface of the mounting component 46, and the insulating spacer 45 is disposed between the head of the mounting component 46 and the fixed conducting component 44 so as to prevent the fixed conducting component 44 from coming into contact with the mounting component 46.

Figure 6:
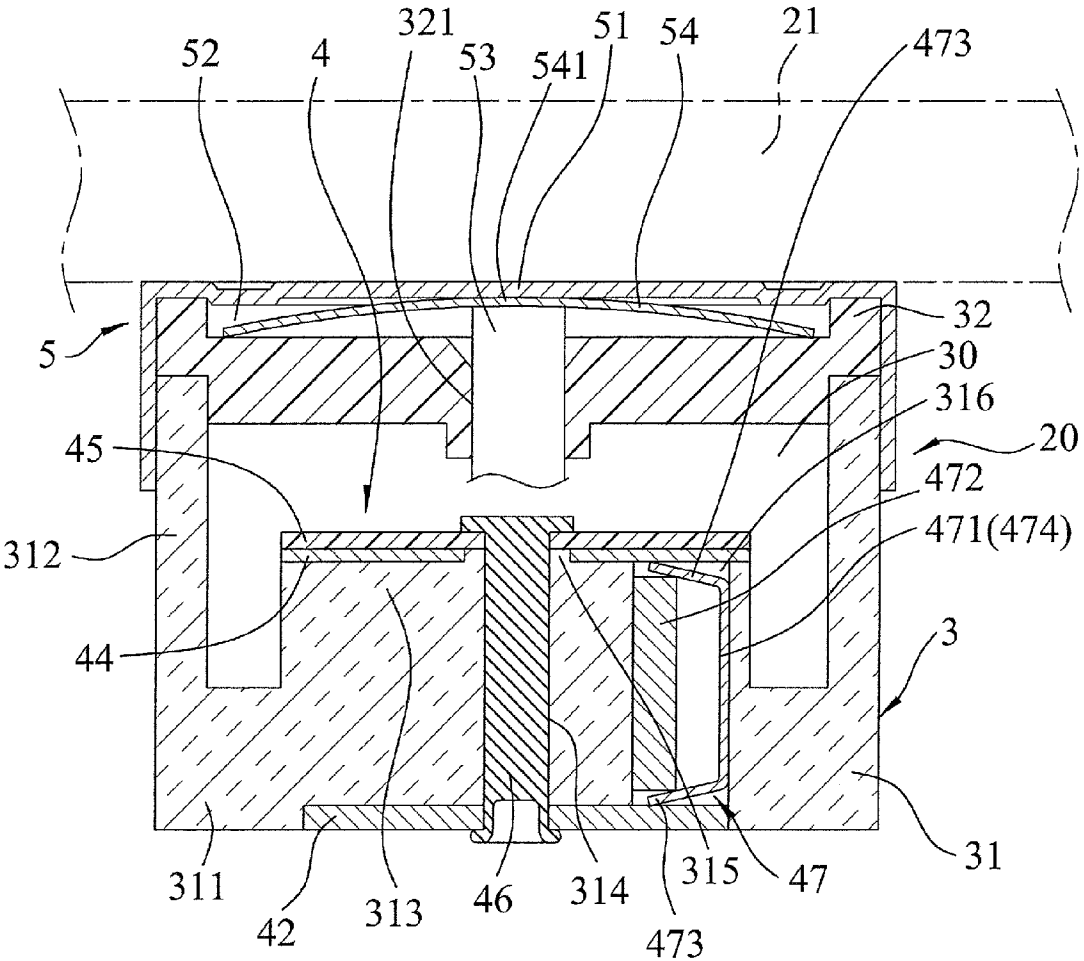
FIG. 6 is a sectional view taken along line VI-VI in FIG. 4, showing that the preferred embodiment is in a conducting condition.

The conducting resilient piece 40 has a resilient arm 401. The resilient arm 401 has a movable contact 402 proximate to a free end thereof, and a biased portion 403 disposed on a middle part thereof. The fixed conducting component 44 has a fixed contact 441 aligned with the movable contact 402 of the conducting resilient piece 40. The safety unit 47 includes a conducting resilient bracket 471, and a temperature-dependent deformable component 472. The conducting resilient bracket 471 has two contact walls 473 spaced apart from each other, and a connecting wall 474 interconnecting the contact walls 473. The contact walls 473 extend slantingly toward each other from two ends of the connecting wall 474 in an original shape of the conducting resilient bracket 471. The temperature-dependent deformable component 472 is made of an alloy material that is bendable and deformable when heated to a specific deforming temperature designed as required. The temperature-dependent deformable component 472 is disposed between and abuts against the contact walls 471. Two ends 475 of the temperature-dependent deformable component 472 respectively bias the contact walls 473, thereby deforming the conducting resilient bracket 471 such that the contact walls 473 extend slantingly away from each other from the two ends of the connecting wall 474, as shown in FIG. 6. Therefore, the deformed conducting resilient bracket 471 has a restoring force applied on the two ends 475 of the temperature-dependent deformable component 472.

The temperature control mechanism 5 includes a temperature-sensing cap 51 made of a heat-conductive material and connected to the cap body 32 of the base 3 to form a deformation space 52 between the cap body 32 and the temperature-sensing cap 51, a linking rod 53 that passes through the limiting hole 321 of the cap body 32, and a temperature-sensing control plate 54 that is disposed in the deformation space 52, that contacts the temperature-sensing cap 51, and that has a deforming part 541 disposed at a central portion thereof and deformable due to temperature change in such a manner to move between a proximate position and a distal position farther away from the conducting resilient piece 40 than the proximate position. The linking rod 53 is made of a heat-insulating ceramic material and is disposed movably in the limiting hole 321. The linking rod 53 is aligned with the deforming part 541, and is disposed between and in contact with the temperature-sensing control plate 54 and the biased portion 403 of the conducting resilient piece 40.

Referring to FIGS. 3, 5 and 6, in this embodiment, when the temperature switch 20 is in a conducting condition, the deforming part 541 of the temperature-sensing control plate 54 is at the distal position, and the linking rod 53 is not pressed against the conducting resilient piece 45, so that the movable contact 402 on the resilient arm 401 of the conducting resilient piece 45 is in contact with the fixed contact 441. Furthermore, in the conducting condition, the temperature-dependent deformable component 472 biases the contact walls 473 of the conducting resilient bracket 471, such that the contact walls 473 are respectively and electrically connected to the second conducting piece 42 and the fixed conducting component 44. In other words, each of the contact walls 473 has a conducting portion that abuts against a respective one of the second conducting piece 42 and the fixed conducting component 44, thereby resulting in a closed circuit through the first wire 22, the first conducting piece 41, the conducting resilient piece 40, the fixed conducting component 44, the safety unit 47, the second conducting piece 42 and the second wire 23.

When the heating component 21 is heated to reach a pre-determined first temperature, the deforming part 541 of the temperature-sensing control plate 54 moves from the distal position to the proximate position, so that the linking rod 53 is pressed against the biased portion 403 of the conducting resilient piece 40, and the movable contact 402 on the resilient arm 401 of the conducting resilient piece 45 is spaced apart from the fixed contact 441, such that electrical connection between the first and second wires 22, 23 is broken. When temperature of the heating component 21 drops to a predetermined second temperature, the deforming part 541 of the temperature-sensing control plate 54 moves from the proximate position back to the distal position, such that the heater of the electrical appliance will perform a heating operation once again.

Figure 7:
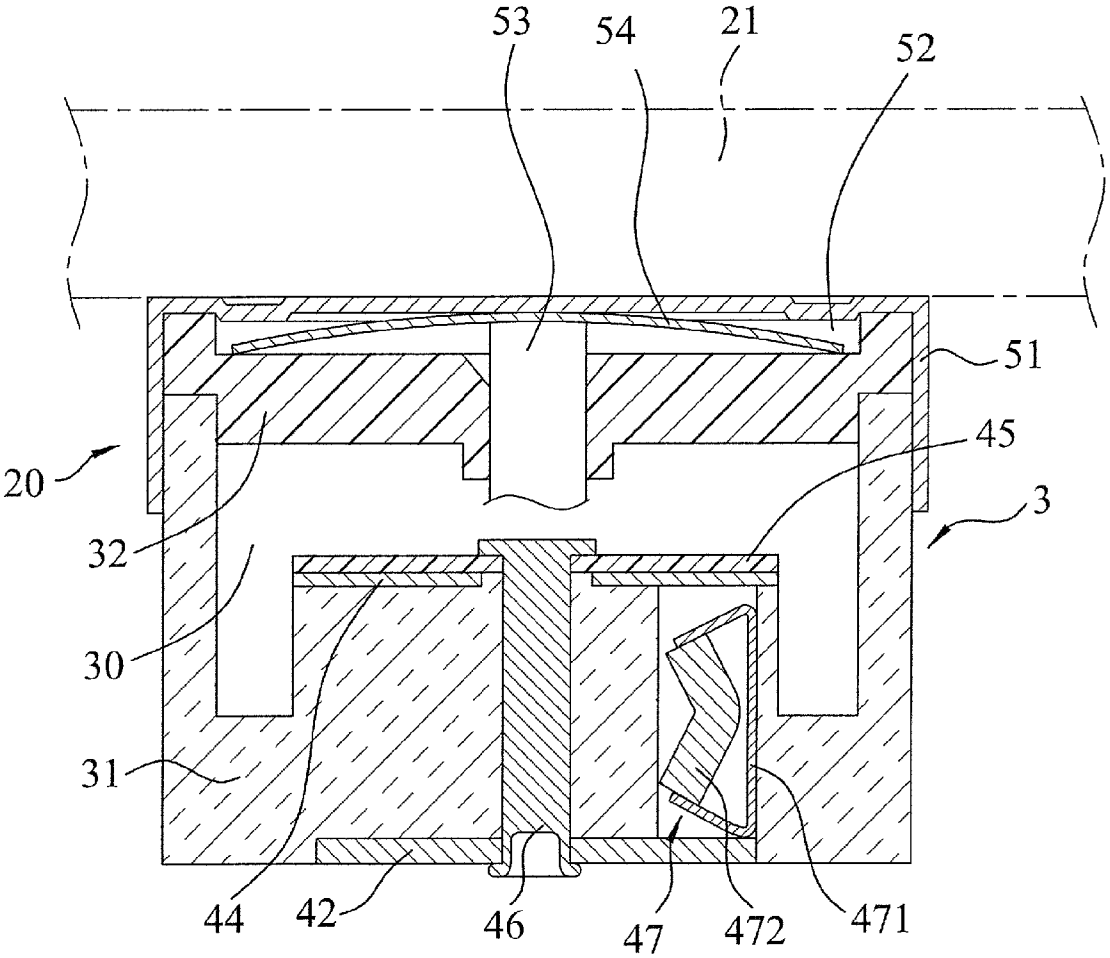
FIG. 7 is a sectional view similar to FIG. 6, showing that the preferred embodiment is in a non-conducting condition.

Referring to FIGS. 3, 5 and 7, when the temperature switch 20 is in the conducting condition, if the temperature of the heating component 21 is higher than the predetermined first temperature while the temperature-sensing control plate 54 is disabled from deformation, or the conducting resilient piece 40 is abnormally in contact with the fixed contact 441 of the fixed conducting component 44, the heater of the electrical appliance will keep on heating to thereby result in an increase in the temperature of the temperature-sensing cap 51 and the environmental temperature thereof. When the environmental temperature rises to a specific temperature, the temperature-dependent deformable component 472 is deformed, so as to change the conducting resilient bracket 47 to a non-conducting state where the resilient conducting bracket 47 is resiliently restored to its original shape such that one of the contact walls 473 is separated from a corresponding one of the second conducting piece 42 and the fixed conducting component 44, as shown in FIG. 7. In detail, the contact walls 473 bend toward the connecting wall 474 such that the conducting portion of one of the contact walls 473 is separated from the corresponding one of the second conducting piece 42 and the fixed conducting component 44. That is, the temperature switch 20 is converted from the conducting condition as shown in FIG. 6 into the non-conducting condition as shown in FIG. 7.

As mentioned above, the temperature switch 20 according to the present invention uses the temperature-dependent deformable component 472 that abuts against the conducting resilient bracket 471 to cause the contact walls 473 of the conducting resilient bracket 471 to be respectively and electrically connected to the second conducting piece 42 and the fixed conducting component 44 in the conducting condition. When the environment temperature rises to a specific temperature and the temperature switch 20 operates abnormally, the electrical connection between the first and second conducting pieces 41, 42 can be broken by virtue of deformation of the temperature-dependent deformable component 472 and the restoring force of the conducting resilient bracket 471. Since the electrical connection is broken by the restoring force of the conducting resilient bracket 471, the drawback of the abovementioned prior art can be effectively overcome. In addition, in the preferred embodiment, both of the isolating ring 315 and the insulating spacer 45 are designed to prevent the fixed conducting component 44 from coming into contact with the mounting component 46. However, if the mounting component 46 is made of a non-conductive material, it is not necessary for the temperature switch 20 of the pre sent invention to include the isolating ring 315 and the insulating spacer 45.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A temperature switch to electrically interconnect a first wire and a second wire, said temperature switch comprising:

a base body;

a cap body connected to said base body to form an accommodating chamber therebetween;

a conducting mechanism including a first conducting piece to be electrically connected to the first wire, a second conducting piece to be electrically connected to the second wire, a fixed conducting component, a conducting resilient piece that is disposed in said accommodating chamber, that is electrically connected to said first conducting piece, and that is contactable with said fixed conducting component, and a safety unit, said safety unit including a conducting resilient bracket, and a temperature-dependent deformable component abutting against said conducting resilient bracket to bias said conducting resilient bracket into a conducting state where said conducting resilient bracket electrically interconnects said fixed conducting component and said second conducting piece, wherein said temperature-dependent deformable component is deformed upon reaching a specific temperature, such that said conducting resilient bracket is changed to a non-conducting state where said conducting resilient bracket is separated from one of said second conducting piece and said fixed conducting component; and a temperature control mechanism controlling contact between said conducting resilient piece and said fixed conducting component with a sensed temperature;

wherein said resilient conducting bracket has two contact walls spaced apart from each other, and a connecting wall interconnecting said contact walls, said temperature-dependent deformable component being disposed between and abutting against said contact walls;

wherein, in the conducting state, said temperature-dependent deformable component biases said contact walls, such that said contact walls are respectively and electrically connected to said second conducting piece and said fixed conducting component; and wherein, in the non-conducting state, said resilient conducting bracket is resiliently restored to an original shape thereof such that one of said contact walls is separated from a corresponding one of said second conducting piece and said fixed conducting component.

2. The temperature switch as claimed in claim 1, wherein each of said contact walls has a conducting portion that abuts against a respective one of said second conducting piece and said fixed conducting component in the conducting state; and in the non-conducting state, said one of said contact walls bends toward said connecting wall such that said conducting portion of said one of said contact walls is separated from the corresponding one of said second conducting piece and said fixed conducting component.

3. The temperature switch as claimed in claim 1, wherein said conducting mechanism further includes an insulating spacer disposed above and abutting against said fixed conducting component, and a mounting component that has a head and mounts said insulating spacer, said fixed conducting component, and said second conducting piece to said base body, said insulating spacer being disposed between said head of said mounting component and said fixed conducting component so as to prevent said fixed conducting component from coming into contact with said mounting component.

4. The temperature switch as claimed in claim 3, wherein said base body has:

a base wall, and a surrounding wall extending upwardly from a periphery of said base wall;

a platform extending upwardly from said base wall;

a mounting hole that passes through said base wall and said platform, and that permits said mounting component to extend therethrough;

an isolating ring that protrudes from said platform and that surrounds said mounting hole, said fixed conducting component being sleeved on said isolating ring for preventing said fixed conducting component from coming into contact with said mounting component; and a receiving space that passes through said platform and said base wall, and that receives said safety unit.

5. The temperature switch as claimed in claim 4, wherein said cap body has a limiting hole, and said temperature control mechanism includes:

a temperature-sensing control plate having a deforming part deformable due to temperature change in such a manner to move between a proximate position and a distal position farther away from said conducting resilient piece than the proximate position; and an insulative linking rod that passes through said limiting hole, and that is disposed between and in contact with said deforming part of said temperature-sensing control plate and said conducting resilient piece such that, when said deforming part of said temperature-sensing control plate is at the distal position, said conducting resilient piece is in contact with said fixed conducting component, and when said deforming part of said temperature-sensing control plate is at the proximate position, said conducting resilient piece is spaced apart from said fixed conducting component.

6. The temperature switch as claimed in claim 5, wherein said temperature control mechanism further includes a temperature-sensing cap connected to said cap body to form a deformation space between said cap body and said temperature-sensing cap for receiving said temperature-sensing control plate.

7. The temperature switch as claimed in claim 1, wherein said cap body has a limiting hole, and said temperature control mechanism includes:

a temperature-sensing control plate having a deforming part deformable due to temperature change in such a manner to move between a proximate position and a distal position farther away from said conducting resilient piece than the proximate position; and an insulative linking rod that passes through said limiting hole, and that is disposed between and in contact with said deforming part of said temperature-sensing control plate and said conducting resilient piece such that, when said deforming part of said temperature-sensing control plate is at the distal position, said conducting resilient piece is in contact with said fixed conducting component, and when said deforming part of said temperature-sensing control plate is at the proximate position, said conducting resilient piece is spaced apart from said fixed conducting component.

* * * * *